United States Patent [19]

Pelerin

[11] 4,351,854

[45] Sep. 28, 1982

[54] METHOD OF PROTECTING DEVICES FOR GALVANIZING METAL PRODUCTS

[75] Inventor: Jacques Pélerin, Angleur, Belgium

[73] Assignee: Centre de Recherches Metallurgiques-Centrum voor Research in de Metallurgie, Brussels, Belgium

[21] Appl. No.: 208,032

[22] Filed: Nov. 18, 1980

[30] Foreign Application Priority Data

Nov. 21, 1979 [BE] Belgium ..... 880195

[51] Int. Cl.[3] ..... C23C 1/02

[52] U.S. Cl. ..... 427/34; 427/397.7; 427/405; 427/419.2; 427/433; 118/429

[58] Field of Search ..... 427/344, 397.7, 397.8, 427/419.2, 419.3, 419.4, 34, 433; 118/429, 423, 424

[56] References Cited

U.S. PATENT DOCUMENTS 2,875,096 2/1959 Diehl et al. ..... 427/433

FOREIGN PATENT DOCUMENTS 2446169 4/1976 Fed. Rep. of Germany ..... 427/34

2813357 10/1979 Fed. Rep. of Germany ..... 427/34

53-25293 7/1978 Japan ..... 427/433

1533193 11/1978 United Kingdom .

OTHER PUBLICATIONS

Karpinos et al., Sov. Powder Metal. & Metal. Ceram. (USA), vol. 11, No. 3, (III) (Nov. 1972), pp. 253, 254.

*Primary Examiner*—Ralph S. Kendall

*Attorney, Agent, or Firm*—Holman & Stern

[57] ABSTRACT

The invention relates to a method of protecting devices designed for the galvanization of metal products, in particular for the galvanization of continuous drive cylinders used when galvanizing sheet on a single surface. A surface layer of the cylinders is coated with one or more oxide, one or more silicate, one or more zirconate, one or more mixed inorganic compound. Examples of the oxides include Mg, Ca, etc. Examples of the silicates include Al etc. Examples of the zirconates include Mg etc. Examples of the mixed inorganic compounds include serpentines, amphiboles, silicon carbide. The oxides are applied directly to the cylinder surface to be formed "in situ", for example, by heating in air to approximately 1000° C.

16 Claims, No Drawings

METHOD OF PROTECTING DEVICES FOR GALVANIZING METAL PRODUCTS

BACKGROUND OF THE INVENTION

1. Field of the Invention

The present invention relates to a method of protecting devices for the galvanization of metal products. It may be applied in a particularly advantageous manner to the continuous galvanization of steel sheet, in particular when such galvanization is only to be carried out on a single surface.

2. Description of the Prior Art

The following description is based on this latter case, but is given purely by way of non-limiting example.

It is known that the protection of steel sheet used in the automobile industry is often carried out by galvanization on a single surface, as the other surface is designed to be covered with a layer of paint.

The galvanization of a single surface may be carried out in several ways, for example by electrolytic deposition or by immersion of both surfaces and then removal of most of the deposit on one of the surfaces by electrolytic or mechanical means.

In accordance with other methods, a product, which prevents contact with zinc, is deposited on one of the surfaces before galvanization, and this product is removed after the galvanization operation.

In a prior patent, the applicants have proposed a device for galvanization of a single surface which may be used on existing galvanization lines with slight modification of these lines.

This method is characterised in that the sheet, before being contacted with a zinc bath, is wound about a rotary cylinder, partially immersed in the zinc bath. Contact of the sheet with the cylinder is carried out before contact of the sheet with the zinc on input to the bath, and is continued on discharge from the bath after the sheet - zinc contact has been interrupted, the surface adjacent to the cylinder not therefore being subjected to contact with the zinc.

In order to carry this operation out successfully, it is obviously necessary for the surface of the cylinder about which the sheet is partially wound to be treated in such a way that it is not reactive with zinc. In particular, the ends of the cylinder, which are not in contact with the sheet, should not be capable of being galvanised or removing zinc, so as to avoid zinc contacting the surface of the sheet to be masked during lateral movements of the sheet, which may not be avoided or during variations of the sheet width.

As far as the applicants know, no completely effective method has up to now been proposed in order to solve the problem to which the present invention aims to provide a particularly advantageous solution.

SUMMARY AND DETAILED DESCRIPTION OF THE INVENTION

According to the present invention, a method of protecting devices designed for the galvanization of metal products, and in particular for the continuous drive cylinder for sheet to be galvanized on a single surface, wherein the cylinders have at least one surface layer which comprises one or more of:

one or more oxide,
one or more silicate,
one or more zirconate, one or more mixed inorganic compound.

The oxide group comprises the oxides of Mg, Ca, Sr, Ba, Ti, Zr, Cr, W, Fe, Co, Ni, Zn, Cd, B, Al, Si, Ge, Sn, Pb.

The silicate group comprises the silicates of Li, Na, K, Mg, Ca, Sr, Ba, Zr, V, Cr, Mn, Fe, Co, Ni, B, Al, Sn, Pb.

The zirconate group comprises the zirconates of Mg, Ca, Sr, Ba.

The "mixed" group comprises serpentines, amphiboles, silicon carbide.

In the particular case of the use of a material containing aluminium silicate, the most advantageous content by weight of $Al_2O_3$ is between 35% and 75% of the weight of the said material which may be used directly, or in the form of powder or in a fibrous form.

A cylinder whose surface is constituted in this way has the following advantages:

absence of reaction with zinc,
no removal of the zinc during the rotation of the cylinder,
no wettability by the zinc,
high mechanical strength, even at the surface,
ease of constitution.

Several methods may be advantageously used to constitute the layer. It is possible in particular to apply the oxides directly to the cylinder to form them "in situ" (for example, by heating in air to approximately 1000° C.), after application of the corresponding metal in the form of paint, the application being carried out using a binding agent such as, for example, organic silicates (ethylene silicate), alkaline silicates (K, Na, Li), or colloidal silica, which may also be used for the stopping of the surface covered in this way.

According to a further effective method, deposition is carried out by means of a plasma torch using the material in question to constitute the protective coating.

In this latter case it is advantageous to provide a nickel- and/or aluminium-based sub-layer, also deposited by plasma methods.

Amongst the materials mentioned above, preference is given to $Zr.MgO_3$.

According to another advantageous varient, in particular in the case in which the material designed to form the protective coating is deposited by a plasma torch on the cylinder, a film of ethyl silicate is deposited on the protective layer, which film, under the effect of heat, decomposes with the formation of silica which blocks the micropores, which may be located on the external surface of the protective layer. The ethyl silicate is preferably hydrolysed, which facilitates the formation of the silica.

By way of example, a coating was provided by spraying in the first instance with an intermediate layer of nickel-aluminium alloy, followed by spraying with magnesium zirconate. The total thickness of the coating was approximately 400 microns. The plates coated in this way were immersed in zinc for two months and at the end of this test no action was observed, and there had been no appreciable removal of the zinc by adherence. This same product was also used after application to a cylinder forming part of a pilot line. During these tests it was observed that the coating, having a total thickness of 450 μm, i.e. 300 μm for the $Zr.MgO_3$ and 150 μm for the NiAl intermediate layer, not only completely withstood passage of the steel sheet, but also ensured the impermeability in respect of the zinc of the surface of the steel to be protected. It was observed that the large interfacial energy between the zinc and the coating led to negative forces of capillarity which prevented any infiltration of the zinc between the sheet and the cylinder, even when an interstice was accidentally formed.

The method described above is also applicable in the case of the protection of the interior of a galvanization tank (steel tank containing zinc) or of various equipment, such as thermocouple sheaths, tools etc.

I claim:

1. In a process for the galvanization of metal products, a method of protecting a device which comes into contact with zinc during galvanization, the method comprising depositing an intermediate layer of at least one metal selected from the group consisting of nickel and aluminum on the device and depositing on the intermediate layer a surface layer comprising at least one constituent selected from the group consisting of the oxides of Mg, Ca, Sr, Ba, Ti, Zr, Cr, W, Fe, Co, Ni, Zn, Cd, B, Al, Si, Ge, Sn, and Pb, the zirconates of Mg, Ca, Sr, and Ba, serpentine, the amphiboles, and silicon carbide.

2. A method as claimed in claim 1, including applying at least one of the oxides directly to the device.

3. A method as claimed in claim 2, wherein the at least one oxide is formed on the device by deposition on the device of the corresponding metal followed by heating to a high temperature and under an oxidising atmosphere in order to cause oxidation "in situ".

4. A method as claimed in claim 3, wherein the contact between the deposited metal and the device is facilitated by the presence of at least one binding agent selected from the group consisting of organic and alkaline silicates and colloidal silica.

5. A method as claimed in claim 1, wherein a film of ethyl silicate, which is hydrolysed, is deposited on the surface layer.

6. A method as claimed in claim 1, wherein the surface layer further comprises at least one constituent selected from the group consisting of the silicates of Li, Na, K, Mg, Ca, Sr, Ba, Zr, V, Cr, Mn, Fe, Co, Ni, B, Al, Sn, and Pb.

7. A method as claimed in claim 6, wherein the surface layer comprises aluminium silicate and having $Al_2O_3$ content by weight of between 35% and 75% of the weight of the layer.

8. A method as claimed in claim 1, wherein said intermediate layer comprises a nickel-aluminum alloy, and said surface layer comprises magnesium zirconate, both layers being applied by plasma spraying, the total thickness of the two layers being from about 400 to about 450 microns.

9. In a process for the galvanization of metal products, a method of protecting a device which comes into contact with zinc during galvanization, the method comprising providing the device with a surface layer comprising at least one constituent selected from the group consisting of the zirconates of Mg, Ca, Sr, and Ba, and a film of ethyl silicate is deposited on the surface layer.

10. A method as claimed in claim 9, further comprising, before depositing the surface layer, depositing an intermediate layer on the device by a plasma technique, the intermediate layer mainly comprising at least one metal selected from the group consisting of nickel and aluminum.

11. A method as claimed in claim 10 or 1, wherein the surface layer mainly comprises magnesium zirconate.

12. In a process for the galvanization of metal products, a method of protecting a device which comes into contact with zinc during galvanization, the method comprising providing the device with an intermediate layer comprising at least one metal selected from the group consisting of nickel and aluminum, providing a surface layer comprising at least one constituent selected from the group consisting of the zirconates of Mg, Ca, Sr and Ba and depositing on the surface layer a film of material which decomposes when heated to form silica.

13. A method as claimed in claim 12, wherein said silica forming material is ethyl silicate.

14. A method as claimed in claim 12 wherein said intermediate layer is deposited by plasma spraying.

15. A method as claimed in claim 9 or claim 12, wherein the surface layer is deposited by means of a plasma torch.

16. A method as claimed in claim 9 or claim 13, wherein said ethyl silicate is applied in hydrolyzed form.

* * * * *